US005769270A

United States Patent [19]

Fujisawa et al.

[11] Patent Number: 5,769,270

[45] Date of Patent: Jun. 23, 1998

[54] TAPE OR SHEET DISPENSER

[75] Inventors: Shin Fujisawa, Kawasaki; Takashi Sugibuchi, Sagamihara, both of Japan

[73] Assignee: Minnesota Mining and Manufacturing Company, St. Paul, Minn.

[21] Appl. No.: 628,681

[22] PCT Filed: Nov. 16, 1994

[86] PCT No.: PCT/US94/13229

§ 371 Date: Apr. 16, 1996

§ 102(e) Date: Apr. 16, 1996

[87] PCT Pub. No.: WO95/14578

PCT Pub. Date: Jun. 1, 1995

[30] Foreign Application Priority Data

Nov. 25, 1993 [JP] Japan ..... 5-295086

[51] Int. Cl.[6] ..... B65H 1/00

[52] U.S. Cl. ..... 221/34; 221/63; 221/155

[58] Field of Search ..... 221/33, 34, 63, 221/155

[56] References Cited

U.S. PATENT DOCUMENTS

| | | | |
|---|---|---|---|
| 4,586,630 | 5/1986 | Loder | 221/63 |
| 4,653,666 | 3/1987 | Mertens | 221/45 |
| 4,993,590 | 2/1991 | Windorski | 221/45 |
| 5,401,547 | 3/1995 | Blackwell et al. | 221/63 |

FOREIGN PATENT DOCUMENTS

| | | | |
|---|---|---|---|
| 0 159 164 | 10/1985 | European Pat. Off. | 221/63 |

*Primary Examiner*—H. Grant Skaggs

[57] ABSTRACT

A refillable tape or sheet flag dispenser for dispensing sheets from a stack includes a bottom section and a pair of elastically deformable wing sections extending from opposite ends of the bottom section in overlapping spaced relation relative to the bottom section, thereby forming a generally flat C-shaped dispenser configuration. When the tape or sheet flags in the tape or sheet dispenser are exhausted, the wings are elastically flexed to allow the dispenser to accommodate a new stack of tape or sheet flags.

12 Claims, 4 Drawing Sheets

TAPE OR SHEET DISPENSER

BACKGROUND OF THE INVENTION

1. Field of the Invention

The present invention relates to a tape or sheet dispenser for supplying reseparable adhesive memorandum tapes or sheets of paper, for example, tape flags accommodated therein.

2. Description of the Related Arts

A tape dispenser for supplying tape flags disclosed in Laid-Open Japanese Patent Publication No. 4-504004 is described below as an example of a conventional reseparable adhesive tape commercially available. As shown in FIGS. 6 and 7, a colored plastic case 31 accommodates a plurality of tape flags 30, in the same color, connected with each other by adhering respective one ends thereof zigzag. Then, a board 33 is adhered to the bottom surface of the case 31 so as to hold the tape flags 30 in the case 31. By pulling the front end of the first tape flag 30 projecting upward from an opening 32 disposed at the center of the upper surface of the case 31, the rear end of the first tape flag 30 is taken out from the opening 32 and the subsequent (second) tape flag 30, one end of which has been adhered to the back surface of the other end of the first tape flag 30 projects upward from the opening 32, and the other end of the second tape flag 30 is separated from the third tape flag 30. In this manner, the tape flags 30 can be taken out one by one from the case 31.

In the conventional tape dispenser having the above-described construction, the board is adhered to the back surface of the case with adhesive agent. Therefore, when the tape flags have been exhausted, new tape flags cannot be accommodated in the case. That is, the tape dispenser cannot be used again. In addition, the tape-taking-out opening of the plastic case projects from the upper surface thereof and hence, the plastic case is thick. Thus, it is inconvenient to carry the tape dispenser adhered to a note book.

SUMMARY OF THE INVENTION

It is accordingly an object of the present invention to provide a dispenser, for supplying tapes or sheets, which has a take-out opening not projecting from the upper surface thereof and can be carried by putting it on a note book.

In accomplishing these and other objects of the present invention, there is provided a tape or sheet dispenser comprising: a bottom section; and a pair of wing sections, each one edge of which is elastically deformably connected with each of two edges, of the bottom section, opposed to each other lengthwise and other edges of which are opposed to each other and form a take-out opening therebetween, thus forming an approximately flat C-shaped configuration so that a plurality of tapes or sheets reseparably adhered to each other zigzag between the bottom section and the wing sections is taken out from the take-out opening one by one.

Preferably, each wing section can be made of transparent material which allows tapes or sheets accommodated between the wing sections and the bottom section to be seen through the wing sections.

Preferably, the bottom section and the wing sections can be integrally composed of a plastic film, respectively.

Preferably, the width of each wing section can be at least twice as large as the width of each tape or sheet so as to accommodate two kinds of tapes or sheets or more.

Preferably, the thickness of the plastic film can be in the range of from 504 $\mu$m to 500 $\mu$m.

Preferably, the gap of the tape or sheet take-out opening can be in the range of from 3 mm to 8 mm in length.

Preferably, the tapes or sheets can be fixed so that the tapes or sheets are unmovable with respect to the bottom section.

Preferably, the bottom section and each wing section can be each made of a rectangular transparent plastic film; only one edge of each wing section can be elastically deformably connected with one end of the bottom section; and the width of the bottom section and that of each wing section can be at least twice as large as that of each tape or sheet.

According to the above construction, the tape or sheet dispenser comprises the bottom section and the wing section formed on each side of the bottom section, thus forming the approximately flat C-shaped configuration so as to accommodate the tapes or sheets between the bottom section and the wing sections, and the take-out opening does not project from the upper surface of the tape or sheet dispenser. Therefore, the tape or sheet dispenser can be put on a note book.

Because the wing section is elastically deformable, the wing sections are pressed upward alternately when the tape or sheet flags are taken out from the take-out opening. In this manner, the tapes or sheet flags can be taken out one by one from the take-out opening. Further, when the tape or sheet flags accommodated in the tape or sheet dispenser are exhausted, the wings are elastically flexed to accommodate new tape or sheet flags easily. That is, the tape or sheet dispenser can be repeatedly used.

Because the tape or sheet dispenser is composed of a thin plastic film, it is light and thus can be carried with a note book. In addition, the tape or sheet dispenser can be manufactured at a low cost.

The wings can be easily formed only by bending a plastic film.

The tapes or sheets of various widths can be accommodated in the tape or sheet dispenser by adjusting the dimension of the bottom section and the wing sections to that of the tape or sheet flags. The tapes or sheets of two different colors or two sizes can be accommodated in the tape or sheet dispenser by making the width of the wing sections twice as large as the width of the tapes or sheets or more. And the tape or sheet dispenser can be thin because the tapes or sheets are divided into a plurality of groups to reduce the accommodating amount of the tapes or sheets at one position in the tape or sheet dispenser when it accommodates tapes or sheets of one kind, i.e., when the tapes or sheets have the same color or the same size.

Because the bottom section and the wing sections are made of transparent material or semi-transparent material, the amount of the tape or sheet flags in the tape or sheet dispenser can be recognized at a glance.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
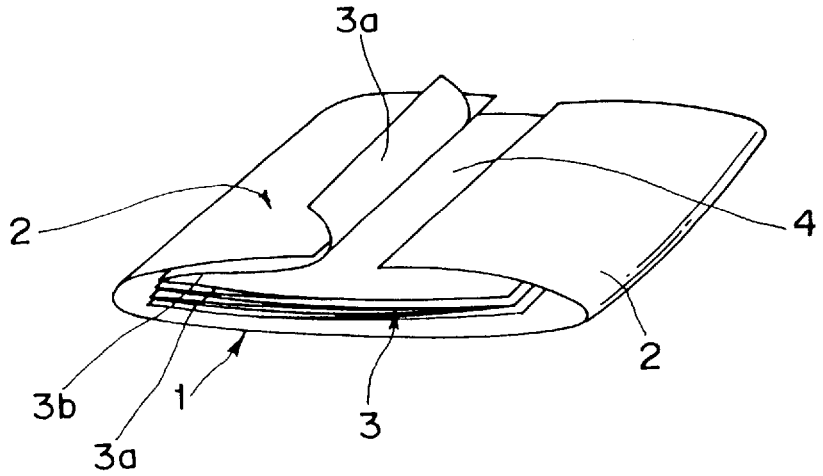
FIG. 1 is a perspective view showing a schematic construction of a tape dispenser for supplying index tapes according to an embodiment of the present invention.

Before the description of the present invention proceeds, it is to be noted that like parts are designated by like reference numerals throughout the accompanying drawings.

A tape dispenser for index tapes as one example of a tape or sheet dispenser according to an embodiment of the present invention will be described below with reference to FIG. 1. FIG. 1 shows the construction of the tape dispenser schematically. The tape dispenser comprises a bottom section 1 and a pair of wing sections 2, each one edge of which is flexibly connected with each of two edges, of the bottom section 1, opposed to each other lengthwise. The other edges of the wing sections 2 are opposed to each other and form a tape flag-take-out opening 4 therebetween, thus forming an approximately flat C-shaped configuration. The tape dispenser accommodates tape flags 3, to be used as index tapes, reseparably adhered to each other zigzag. The tape flags 3 are taken out from the tape flag take-out opening 4 one by one.

Figure 2:
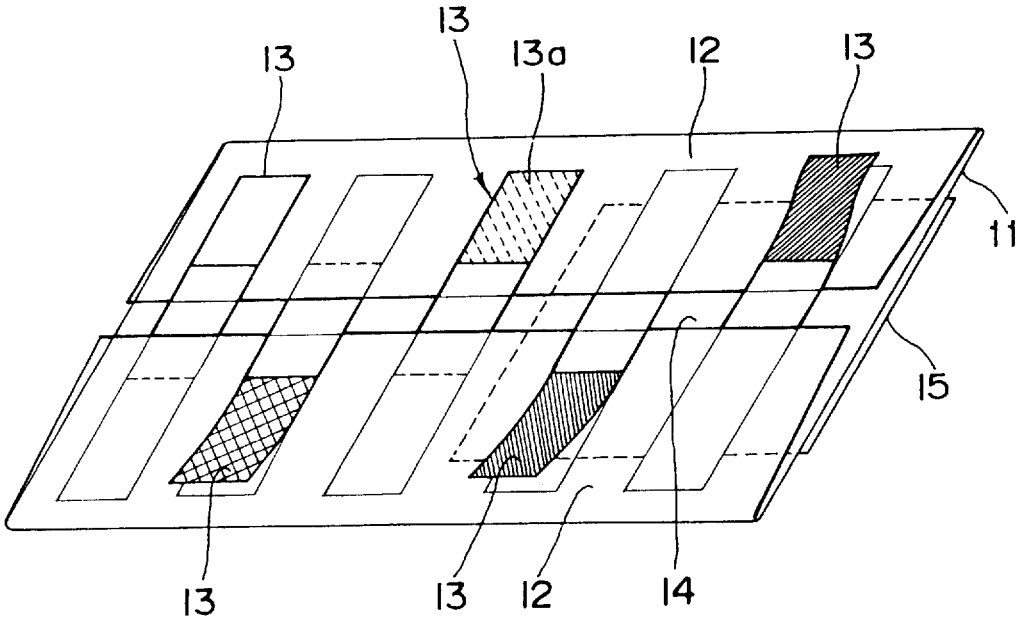
FIG. 2 is a perspective view showing a tape dispenser according to another embodiment of the present invention.

A tape dispenser according to another embodiment of the present invention is described below with reference to FIGS. 2 through 4. The tape dispenser shown in FIG. 1 accommodates only one kind of tape flag, whereas the tape dispenser shown in FIGS. 2 through 4 accommodates more than one set of tape flags 13. The construction of the tape dispenser is similar to that of the tape dispenser shown in FIG. 1. The tape dispenser comprises a bottom section 11 consisting of a rectangular plate and a pair of wing sections 12 consisting of a rectangular plate, each one edge of which is elastically deformably, namely, flexibly connected with each of two edges, of the bottom section 11, opposed to each other widthwise. The other edges of the wing sections 12 are opposed to each other and form a tape flag-take-out opening 14 therebetween, thus forming an approximately flat C-shaped configuration. The tape dispenser accommodates tape flags 13, to be used as index tapes, reseparably adhered to each other zigzag. The tape flags 3 are taken out from the tape flag take-out opening 14 one by one.

A one-piece elastic plastic film is molded to form the bottom section 11 and the wing section 12. A portion corresponding to the wing section 12 is elastically deformably folded back at the border between the bottom section 11 and the wing section 12 so as to cover the upper surface of the bottom section 11 partly. Therefore, the wing section 12 itself can be elastically bent in an approximately circular arc shape, and the wing section 12 and the bottom section 11 can be elastically bent to each other at the connecting portion between them. Preferably, a transparent or semi-transparent film made of polyvinyl chloride, polyester, polypropylene, or polycarbonate is used as the plastic film. In particular, polyvinyl chloride can be deformed at a low temperature and easily bent and moreover, has a high degree of transparency and inexpensive. Because the bottom section 11 and the wing section 12 are transparent or semi-transparent, the amount of the tape flags 13 can be seen through the plastic film. The plastic film composing the wing section 12 is required to have an appropriate rigidity against a force applied to the wing section 12 in taking out the tape flag 13 from the take-out opening 14. In this respect, favorably, the plastic film has a thickness of 50–500 $\mu$m and more favorably, 100–400 $\mu$m. If the thickness of the plastic film is less than 50 $\mu$m, the plastic film does not have a required mechanical strength and it is difficult for the tape dispenser to securely keep the tape flags 13 therein and becomes difficult to take out the tape flag 13 therefrom during long use. if the thickness of the plastic film is more than 500 $\mu$m, it is difficult to bend it in a manufacturing process. Because both end portions of each wing section 12 in the widthwise direction thereof are not connected with the upper surface of the bottom section 11, the wing section 12 is not prevented from being elastically deformed.

The thickness of the connecting portion between the bottom section 11 and the wing section 12 is thinner by at least 1 $\mu$m, preferably 10 $\mu$m, than that of each of the bottom section 11 and the wing section 12, so as to easily bend and form the integral dispenser. Preferably, the elastic force can be easily controlled while having a sufficient mechanical strength for a dispenser, so that the tape or sheet can be easily taken out. For the similar reason, a cutout can properly be formed at both ends and the middle part of the connecting portion between the wing section 12 and the bottom section 11. The configuration of the cutout is not limited to a specified one, but can be, for example, circular, quadrilateral, triangular. The formation of the cutout prevents an extra force from acting at the connecting portion, specifically, the right and left opened ends of the wing section 12, resulting in improvement of its durability.

Preferably, the length of the take-out opening 14 is 3–8 mm in the widthwise direction of thereof. If the length of the take-out opening 14 is more than 8 mm, a plurality of the tape flags 13 is pulled out from the take-out opening 14 at a time. If the length of the take-out opening 14 is less than 3 mm, it is difficult to take out the tape flag 13 easily. When the length of the take-out opening 14 is in this range, an adhesive agent-applied surface of the tape flag 13 formed from the rear end 13*b* of the tape flag 13 to the vicinity of the center thereof is capable of easily contacting the upper surface of the right or left wing section 12, of FIG. 3, from which the flag portion of the tape flag 13 projects. Therefore, the flag portion of the tape flag 13 is capable of keeping flat without being bent upward. Thus, the tape dispenser is portable and can be preferably used for a note book. The adhesive agent-applied surface does not necessarily contact the upper surface of the wing section 12.

The tape flags 13 can be accommodated between the bottom section 11 and the wing section 12 by making the dimension of the bottom section 11 in the width direction thereof larger than the dimension of the tape flag 13 in the longitudinal direction thereof. It is possible to differentiate a plurality of the tape flags 13 from each other in color and size.

Figure 3:
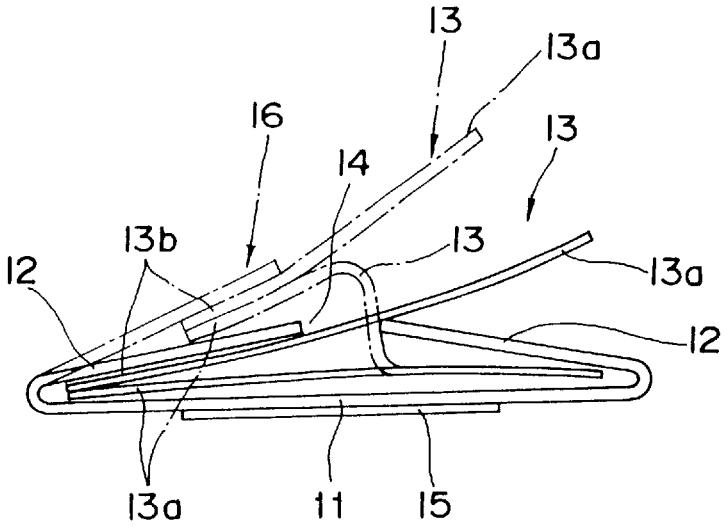
FIG. 3 is a plan view showing the tape dispenser shown in FIG. 2.
Figure 4:
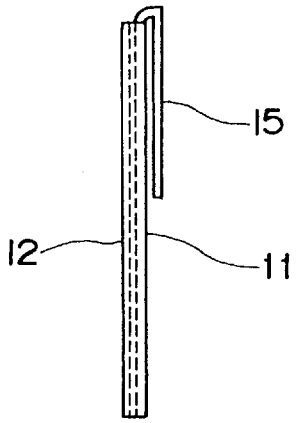
FIG. 4 is a side view showing the tape dispenser shown in FIG. 2.

A clip 15 shown in FIGS. 3 and 4 is used to insert a board of a note book between the clip 15 and the bottom section 11. In this manner, the tape dispenser can be fixed to the board.

As disclosed in Japanese Laid-Open Patent Publication No. 4-504004, the tape flags 13 are flexible tapes previously cut and laminated one on the other as transparent index tapes having reseparable adhesive agent applied to one surface of respective rear ends 13*b* piled zigzag one on the other. As material of a tape film composing the tape flag 13, flexible polymer such as cellulose acetate is preferably used. Preferably, the thickness of the tape film is 0.0056 cm, namely, 0.0022 inches or in the range of from, 0.0038 to 0.0076 cm. It is possible that one end of the tape flag 13 can be colored to classify the tape flags 13 into each other. The lower end portion of the tape flag 13 in contact with the bottom section 11 is pressed at a certain force against the bottom section 11 by the right and left wing sections 12. Therefore, the tape flag 13 is prevented from moving lengthwise or widthwise. In order to prevent the tape flag 13 from moving lengthwise or widthwise more securely, the adhesive agent-applied surface of the tape flag 13 can be in contact with the bottom section 11. Accordingly, the lower end of the tape flag 13 is not necessarily fixed to the bottom section 11 by using adhesive agent.

According to the above construction, as shown in FIG. 3, the tape flag 13 is pulled, with one end 13*a* of the first tape flag 13 projecting from the take-out opening 14 disposed between the right and left wing sections 12 being grasped by a finger. In this manner, the first tape flag 13 is taken out from the take-out opening 14 without other tape flags 13 being moved in the tape dispenser except the second tape flag 13. One end 13*a* of the second tape flag 13 to be subsequently taken out from the take-out opening 14 is separably adhered to the other end 13*b* of the first tape flag 13. As the first tape flag 13 is being taken out, the second tape flag 13 is flexed in an approximately U-shaped configuration as shown by one-dot chain line of FIG. 3 and the left wing section 12 is elastically deformed in a circular arc shape. This is because the other end 13*b* of the second tape flag 13 is adhered, namely, fixed to one end 13*a* of a third tape flag 13 with adhesive agent. When the other end 13*b* of the first tape flag 13 has been taken out from the take-out opening 14, one end 13*a* of the second tape flag 13 projects from the take-out opening 14. Then, one end 13*a* of the second tape flag 13 is pulled to take out the second tape flag 13 from the take-out opening 14 with the right wing section 12 being elastically deformed. Then, one end 13*a* of the third tape flag 13 is projected from the take-out opening 14. In this manner, the tape flags 13 are sequentially taken out from the take-out opening 14 one by one.

According to the above construction, the tape dispenser comprises the bottom section 1 (11) and the wing section 2 (12) formed on each side of the bottom section 1 (11), thus forming the approximately flat C-shaped configuration so as to accommodate the index tapes 3 (13) between the bottom section 1 (11) and the wing sections 2 (12), and the take-out opening 4 (14) does not project from the upper surface of the tape dispenser. Therefore, the tape dispenser can be put on a note book. Because the wing section 2 (12) is elastically deformable, the wing sections 2 (12) are pressed upward alternately when the tape flags 3 (13) are taken out from the take-out opening 4 (14). In this manner, the tape flags 3 and 13 can be taken out one by one from the take-out opening 4 (14). Further, when the tape flags 3 and 13 accommodated in the tape dispenser are exhausted, the wings 2 (12) are elastically flexed to accommodate new tape flags 3 (13) easily. That is, the tape dispenser can be repeatedly used.

Because the tape dispenser is composed of a thin plastic film, it is light and thus can be carried with a note book. In addition, the tape dispenser can be manufactured at a low cost. For example, the tape dispenser accommodating index tapes can be as thin as 5 mm or less.

The wings 2 (12) can be easily formed only by bending a plastic film.

The index tapes 3 (13) of various widths can be accommodated in the tape dispenser by adjusting the dimension of the bottom section 1 (11) and the wing sections 2 (12) to that of the tape flags 3 (13). The index tapes 3 (13) of two different colors or two sizes can be accommodated in the tape dispenser by making the width of the wing sections 2 (12) twice as large as the width of the index tapes 3 (13) or more. And the tape dispenser can be thin because the index tapes 3 (13) are divided into a plurality of groups to reduce the accommodating amount of the index tapes at one position in the tape dispenser when it accommodates the index tapes 3 (13) of one color or one size.

Because the bottom section 1 (11) and the wing sections 2 (12) are made of transparent material or semitransparent material, the amount of the tape flags 3 (13) in the tape dispenser can be recognized at a glance.

The present invention is not limited to the above-described embodiments but can be embodied in various modifications.

The method of forming the bottom section 1 (11) and the wing sections 2 and 2 (12 and 12) is not limited to bending but can be formed by separately forming them and then adhering connecting portions between the bottom section and the wing sections to each other by adhesive agent or by melting the connecting portions by high frequency heating and then connecting them with each other.

The wing sections 12 can be formed in continuation with the bottom section 11 by the following method: That is, a transparent film made of soft polyvinyl chloride having a thickness of 200 $\mu$m punched into a rectangle of a predetermined size, for example, 8 cm×10 cm by using a pressing machine. Then, by using a pressing machine, pressure is applied to the punched film while the film is being heated at 100° C. for 1–10 seconds to form a wing section 12 on one side of the bottom. Then, a bundle of tape flags 13 is inserted between the wing section 12 and the bottom section 11. Then, the wing section 12 is formed on the other side of the bottom section 11 similarly by using the pressing machine. The bundle of the tape flags 13 can be inserted between the wing sections 12 and the bottom section 11 after the tape dispenser is formed.

Figure 5:
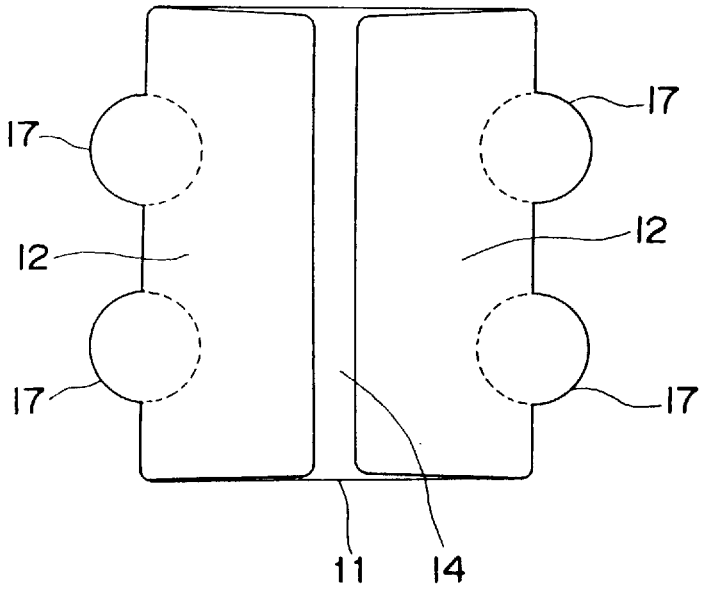
FIG. 5 is a front view showing a tape dispenser according to still another embodiment of the present invention.
Figure 6:
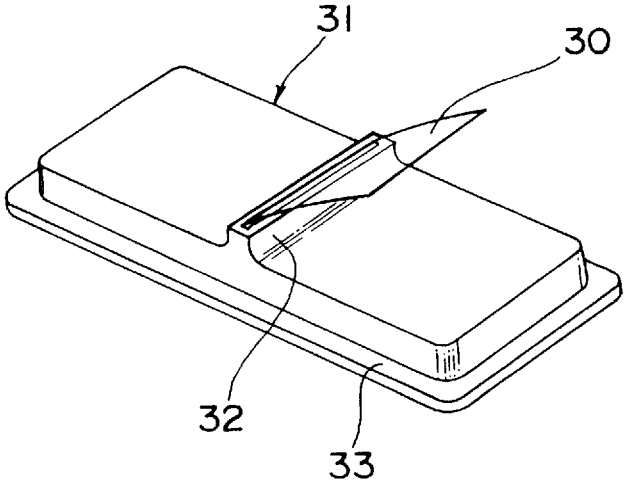
FIG. 6 is a front view showing a conventional tape dispenser.
Figure 7:
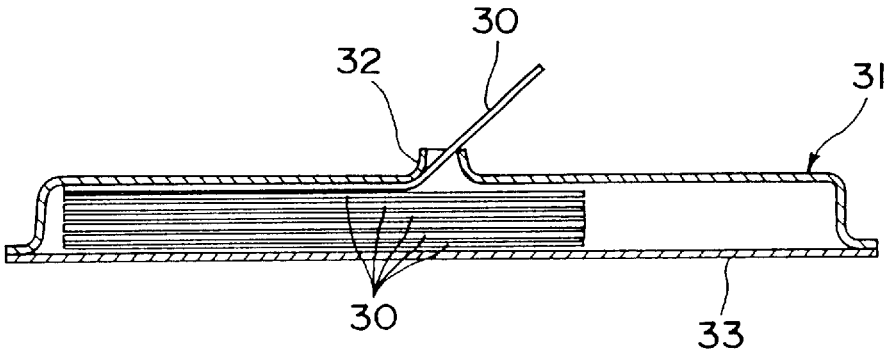
FIG. 7 is a vertical sectional view showing the conventional tape dispenser shown in FIG. 6.

Still another embodiment of the present invention is described below with reference to FIG. 5. Some portions of each edge of the bottom section 11 can be disconnected from the edge of each of the wing sections 12 of the tape dispenser shown in FIG. 2. It is possible to form a plurality of semicircular projections 17 projected from the border between the bottom section 11 and the wing sections 12 so that the projections 17 project from the border. This construction allows the wing sections 12 to be flexed more easily.

Figure 8:
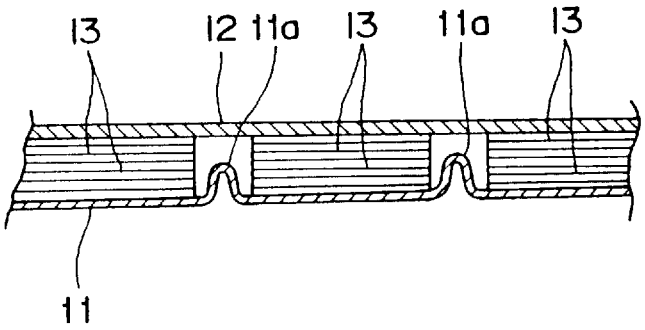
FIG. 8 is an enlarged sectional side view showing a tape dispenser according to a further embodiment of the present invention.

As shown in FIG. 8, in accommodating a plural kind of tape flags 13 in each portion of the tape dispenser, projections 11*a* can be formed on both sides of each portion of the bottom section 11 so as to prevent the tape flags 13 from being dislocated widthwise, namely, right-to-left direction in FIG. 8.

Although the description of the above embodiments are directed to index tapes as one example of tapes or sheets, the present invention is not limited to the index tape. That is, the present invention can be applied to reseparable tapes or sheets.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A refillable sheet dispenser having a generally flat C-shaped configuration for individually dispensing sheets from a stack arranged within the dispenser, comprising:

(a) a generally planar bottom section having remote ends; and (b) a pair of elastically deformable wing sections each extending from a respective bottom section remote end toward the other wing section in overlapping spaced relation relative to said bottom section, thereby allowing a stack of sheets to be accommodated between the wing sections and the bottom section, each said wing section having a terminal edge spaced from and opposing the other wing section terminal edge, thereby defining an opening therebetween, whereby as sheets are dispensed through the opening, each wing section is alternately urged pivotally away from the bottom section, and further whereby when said stack of sheets is exhausted, the wing sections may be elastically flexed to allow a new stack to be accommodated within the dispenser.

2. A dispenser as defined in claim 1, wherein said bottom section and said wing sections are integrally formed of a plastic film having a generally uniform thickness.

3. A dispenser as defined in claim 2, and further including a connecting portion arranged between said bottom section and each said wing section having a thickness less than the thickness of said bottom section and each said wing section, whereby said plastic film easily bends to form the dispenser.

4. A dispenser as defined in claim 3, wherein said plastic film has a thickness in the range of 50$\mu$ to 500 $\mu$m.

5. A dispenser as defined in claim 1, wherein each said wing section is formed of a transparent material, thereby allowing the sheets accommodated between said wing section and said bottom section to be seen through said wing sections.

6. A dispenser as defined in claim 1, wherein each wing section has a width at least twice as large as the width of each sheet, whereby the dispenser can accommodate at least two kinds of sheets.

7. A dispenser as defined in claim 1, wherein said opening has a width in the range of 3 mm to 8 mm.

8. A dispenser as defined in claim 1, wherein the stack of sheets includes a lower-most sheet fixed relative to said bottom section.

9. A dispenser as defined in claim 1, and further including a clip arranged to allow the dispenser to be mounted on a supporting structure.

10. A dispenser as defined in claim 1, wherein the dispenser has an overall thickness of generally less than 5 mm.

11. A dispenser as defined in claim 1, and further including at least one projection extending oppositely from each said bottom section remote end.

12. A dispenser as defined in claim 1, wherein said bottom section further includes projections extending upwardly toward each said wing section between adjacent stacks of sheets, thereby preventing sideways movement of the stacks of sheets arranged within the dispenser.

* * * * *